United States Patent [19]

Hattori

[11] Patent Number: 4,778,425

[45] Date of Patent: Oct. 18, 1988

[54] UNDERWATER JACKET

[76] Inventor: Seiji Hattori, 5-18, Hadori 4-chome, Fujisawa-shi, Kanagawa, Japan

[21] Appl. No.: 65,445

[22] Filed: Jun. 23, 1987

[51] Int. Cl.[4] ..... B63C 9/16

[52] U.S. Cl. ..... 441/88; 405/186; 441/115; 441/106

[58] Field of Search ..... 441/88, 40, 80, 90–101, 441/106–119; 114/345; 405/186

[56] References Cited

U.S. PATENT DOCUMENTS 4,561,853 12/1985 Faulconer et al. ..... 405/186 X

*Primary Examiner*—Sherman D. Basinger
*Assistant Examiner*—Edwin L. Swinehart
*Attorney, Agent, or Firm*—Cushman, Darby & Cushman

[57] ABSTRACT

There is disclosed an underwater jacket including an outside waterproof cloth and an inside waterproof cloth, said outside and inside cloths being put one upon the other and connected together at their marginal edges by sewing to form a jacket body into which air can be injected. The outside and inside cloths are partially connected to each other by high-frequency welding at a portion or portions where the cloths are to be folded or curved during use. At least one hole is formed through the outside and inside cloths at the portion, and a bolt made of plastic material is passed through the hole, while a nut made of plastic material is fitted to a protruding end of the bolt on the other side of the cloths. Packings are interposed between the bolt and nut and the outside and inside cloths, respectively.

1 Claim, 3 Drawing Sheets

UNDERWATER JACKET

BACKGROUND OF THE INVENTION

1. Field of the Invention

The present invention relates to an underwater jacket, which may be used for scuba diving of the like.

2. Description of the Prior Art

Underwater jackets for use in scuba diving include an outside waterproof cloth and an inside waterproof cloth, which are put one upon the other and connected together at marginal edges thereof by sewing to form a jacket body into which air may be injected.

The jacket body is inflated by injecting air thereinto, and, consequently, if the jacket body is formed by connecting the outside and inside cloths to each other only at their maginal edges the jacket body will inflate into a flat mat form, which can hardly fit to a body of a user. In order to make the jacket easily fittable to a user's body, the jacket is usually formed with a portion or portions where the combined cloths can be easily folded or curved. Such portion corresponds, for example, to a boundary portion between a front side part and a rear side part of the jacket body.

Heretofore, it has been proposed to form such an easily foldable portion by welding. FIGS. 3 and 4 illustrate such a construction, in which an outside cloth and an inside cloth are connected together by means of welded portions P at positions where the jacket body is to be folded.

According to the construction that is shown in FIGS. 3 and 4, the outside cloth and the inside cloth are partially connected together by the welded portions P. Therefore, when air is injected into the jacket body, air does not enter into the welded portions P, and thus these portions can be easily folded. This construction has the advantage that the jacket body can be easily folded at the weld portions. However, a disadvantage of this construction is that the parts of the outside and inside cloths, which are connected together only by welding, may be separated during continued use of the jacket. If the cloths are separated, the jacket body becomes inflated at the welded parts, so that is becomes difficult to fold the jacket body at the positions where the jacket body is to be folded.

SUMMARY OF THE INVENTION

It is an object of the present invention to provide an underwater jacket in which means are provided to firmly connect the outside and inside cloths together at positions where the jacket body is to be folder or curved, thereby providing a jacket which is highly durable and easily foldable.

In accordance with the present invention there is provided an underwater jacket including an outside waterproof cloth and an inside water proof cloth which are put one upon the other and connected together at their marginal edges by sewing to form a jacket body into which air can be injected, in which;

the outside and inside cloths are partially connected to each other by high-frequency welding at positions where the cloths are to be folded or curved during use;

at least one hole is formed through the outside and inside cloths at the welded positions;

a bolt made of plastic material is passed through the hole from one side of the outside and inside cloths;

a nut made of plastic material is fitted to a protruding end of the bolt on the other side of said cloth; and packings are interposed between the bolt and nut and the outside and inside cloths, respectively.

According to the construction of the underwater jacket as described above, when air is injected into the jacket the outside cloth and the inside cloth bulge out so that the jacket is inflated with air as a whole, whereby the underwater jacket having suitable buoyancy is formed. The outside cloth and the inside cloth are partially connected together by high-frequency welding at a position or positions and the parts of the cloths thus connected are firmly fixed together by the bolt and the nut through the packings, so that said connected parts are prevented from bulging out by the action of air. Thus the jacket can be folded or curved at the connected parts of the outside and inside cloths. Accordingly, the jacket can be formed into a shape which can easily fit to a user's body. Particularly, this underwater jacket is durable for a long time, since the outside and inside cloths are connected together not only by the high-frequency welded portions but also by the bolts and nuts which pass through the outside and inside cloths.

BRIEF DESCRIPTION OF THE DRAWINGS

FIGS. 1 and 2 illustrate a preferred embodiment of a jacket according to the present invention, in which;

FIG. 1 is a developed plan view of the jacket; and

FIG. 2 is a sectional view taken along a line X—X in FIG. 1.

FIGS. 3 and 4 illustrate a conventional jacket, in which;

FIG. 3 is a developed plan view; and

FIG. 4 is a sectional view taken along a line Y—Y in FIG. 3.

DESCRIPTION OF THE PREFERRED EMBODIMENT

Now the present invention will be described with reference to FIGS. 1 and 2, which illustrate the preferred embodiment of the present invention.

Figure 1:
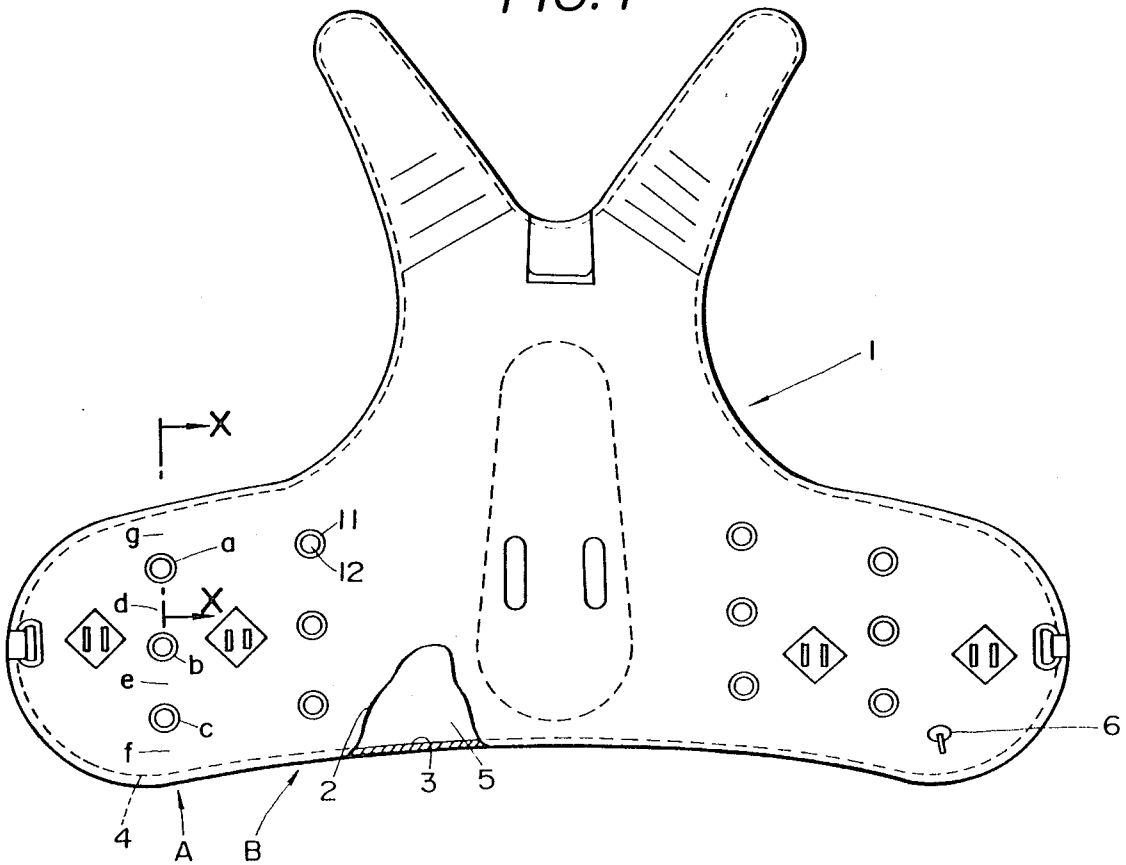
Figure 2:
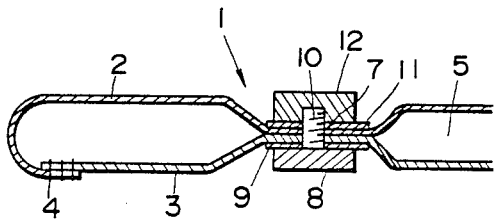
Figure 4:
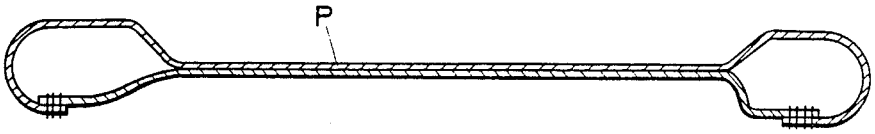
FIG. 4 (PRIOR ART)
Figure 3:
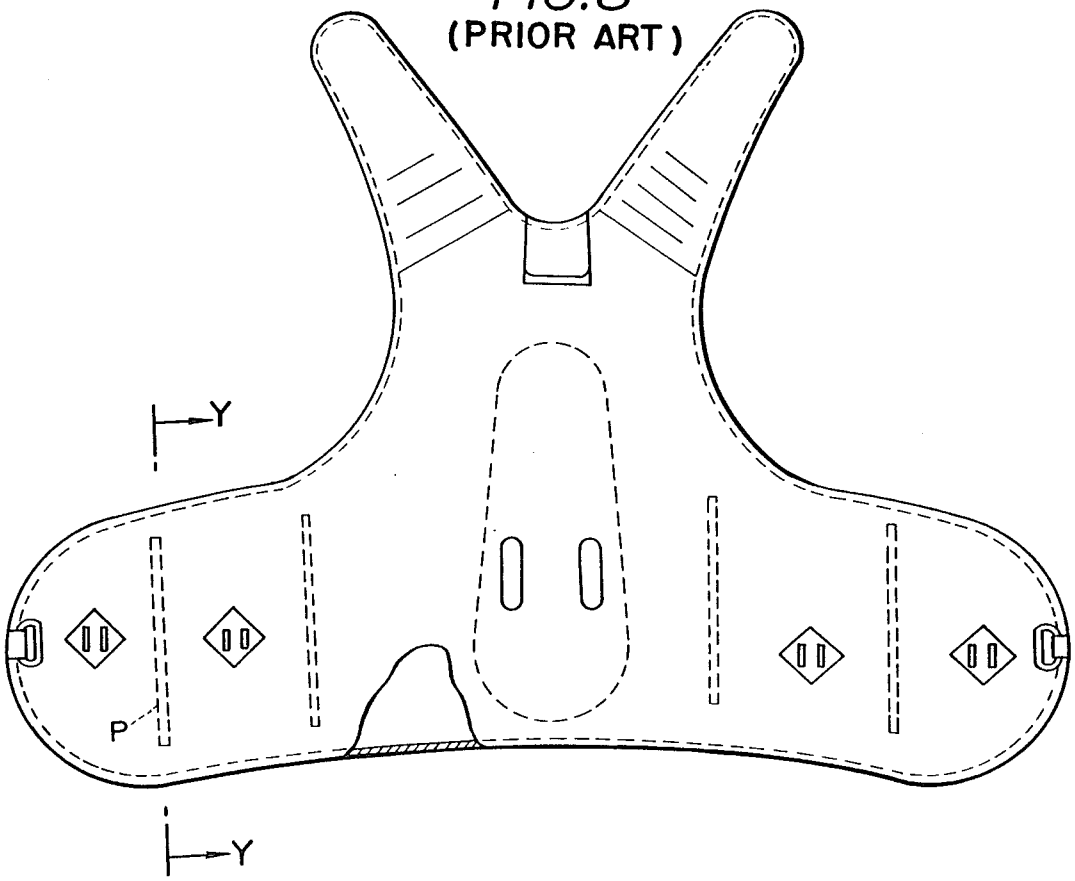
FIG. 3 (PRIOR ART)

FIG. 1 is a developed plan view of the jacket which includes a jacket body 1. The jacket body 1 includes an outside waterproof cloth 2 and an inside waterproof cloth 3, which are put one upon the other and connected together at their marginal edges 4 by sewing to form a flat bag. An air chamber 5 is formed between the outside and inside cloths and air is injected into or exhausted from the air chamber 5 through an air inlet 6.

If the jacket body 1 is simply in the form of the bag as described, the jacket body is inflated into a flat mat shape when air is injected thereinto, so that a scuba diver could hardly wear the jacket body. In order to make the jacket body fittable to the breast and the back of the scuba diver, the jacket body according to the present invention is formed with portions which can be easily folded, at suitable positions such as indicated by A and B.

In order to form such easily foldable portions, the outside cloth 2, and the inside cloth 3 are connected together by high-frequency spot welding at three portions a, b and c along lines indicated by arrows A and B. Portions d, e, f and g between the portions a and b and the portion b and c are defined as air passages, as usual. A hole 7 is formed through the outside and inside cloths at each of the spot-welded portions a, b and c. In this connection it is to be noted that the hole 7 should be formed within the area of the spot-welded portion and should not extend beyond the limit of the spot-welded portion, in order to prevent the hole from communicating with the air chamber. A bolt 8 made of plastic material is passed through the hole from the side of the outside cloth 2. A sealing packing 9 is interposed between the bolt 8 and the surface of the outside cloth 2. A nut 12 made of plastic material is engaged with a thread portion 10 of the bolt 8, which protrudes from the rear side of the inside cloth. A sealing packing 11 is interposed between the nut and the inside cloth.

In the above construction, one of the bolt 8 and the nut 12 may be arranged on any side of the outside and inside cloths, while the other is arranged on the other side of these cloths.

In operation of the above construction, air is introduced into the air chamber 5 through the air inlet 6, so that the outside and inside cloths 2 and 3 are caused to bulge out. However, the outside and inside cloths at the portions a, b, c and the other parts to be folded are connected together by the high-frequency spot welding and further firmly connected by the bolt-nut assemblies 8 and 12, so that these portions cannot be caused to bulge out and remain in their affixed states. Accordingly, the jacket body can be easily folded at these portions, so that the jacket can easily fit to the user's body.

Furthermore, the spot welded portions a, b and c are firmly held by the bolt-nut assembly 8 and 12, so that the cloths cannot be separated even if air is repeatedly introduced and exhausted for an extensive use.

It will be understood that the present invention provides an underwater jacket which is formed with highly durable construction at the portions where the jacket body is to be folded or curved. Thus, the present invention provides an underwater jacket which can better hold its form for a long period of time.

I claim:

1. An underwater jacket including an outside waterproof cloth and an inside water proof cloth which are put one upon the other and connected together at their marginal edges by sewing to form a jacket body into which air can be injected, in which;

said outside and inside cloths are partially connected to each other by high-frequency welding at positions where cloths are to be folded or curved during use;

at least one hole is formed through said outside and inside cloths at said welded positions;

a bolt made of plastic material is passed through said hold from one side of said outside and inside cloths;

a nut made of plastic material is fitted to a protruding end of said bolt on the other side of said cloths; and packings are interposed between said bolt and nut and said outside and inside cloths, respectively.

* * * * *